US006693642B1

(12) United States Patent
Ogawa

(10) Patent No.: US 6,693,642 B1
(45) Date of Patent: Feb. 17, 2004

(54) METHOD AND APPARATUS FOR DISPLAYING IMAGES

(75) Inventor: Eiji Ogawa, Kaisei-machi (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 391 days.

(21) Appl. No.: 09/620,962

(22) Filed: Jul. 21, 2000

(30) Foreign Application Priority Data

Jul. 23, 1999 (JP) ..... 11/209573

(51) Int. Cl.[7] ..... G09G 5/02

(52) U.S. Cl. ..... 345/589; 345/590; 345/591; 345/597; 345/601; 345/602

(58) Field of Search ..... 345/690, 589, 345/88; 348/674, 179, 671; 395/131; 358/302, 1.9; 355/77

(56) References Cited

U.S. PATENT DOCUMENTS 5,619,349 A * 4/1997 Ueda et al. ..... 358/515
5,798,842 A * 8/1998 Yamazaki ..... 355/77
6,008,907 A * 12/1999 Vigneau et al. ..... 348/179
6,084,567 A 7/2000 Ogawa ..... 345/147
6,118,455 A * 9/2000 Hidaka et al. ..... 345/589
6,243,059 B1 * 6/2001 Greene et al. ..... 345/88
6,266,102 B1 * 7/2001 Azuma et al. ..... 348/671
6,404,512 B1 * 6/2002 Tone ..... 345/690

FOREIGN PATENT DOCUMENTS

JP 9-212144 8/1997 ..... G09G/5/10

OTHER PUBLICATIONS

Robert Cowart, Mastering Windows 3.1, 1992, Sybex Inc., 1st Edition.*
Patent Abstract of Japan 09–212144 Aug. 15, 1997.

* cited by examiner

*Primary Examiner*—Matthew C. Bella
*Assistant Examiner*—Mike Rahmjoo
(74) *Attorney, Agent, or Firm*—Sughrue Mion, PLLC

(57) ABSTRACT

According to a degree of brightness degradation of image display means, a gradation conversion table to be used is easily selected. A gradation conversion table storing unit for storing 3 gradation conversion tables having different input/output characteristics, table selection means for selecting one of the 3 gradation conversion tables, a gradation correction unit for carrying out gradation conversion processing on an image signal according to the selected table, image display means for displaying a visible image represented by an image signal after the gradation conversion processing, and a contrast pattern storing unit for storing contrast patterns at a plurality of levels changing gradation recognition performance in accordance with a plurality of levels of the brightness degradation of the image display means are included.

9 Claims, 9 Drawing Sheets

METHOD AND APPARATUS FOR DISPLAYING IMAGES

BACKGROUND OF THE INVENTION

1. Field of the Invention

The present invention relates to an image display method and an image display apparatus for displaying an image on image display means such as a CRT display or a liquid crystal display device. More specifically, the present invention relates to an image display method and an image display apparatus for displaying an image on image display means after carrying out gradation conversion processing according to a predetermined gradation conversion table on an image signal.

2. Description of the Related Art

When a visible image is displayed on image display means such as a CRT display or a liquid crystal display device based on an image signal, gradation correction according to a gradation conversion table is carried out in advance on the image signal.

This is because a gradation characteristic (a characteristic of output brightness to an input signal [image signal]) of image display means shows a nonlinear characteristic as shown in FIG. 5B while a displayed image is assumed to have a linear gradation characteristic as shown in FIG. 5C, for example. Therefore, preset gradation conversion processing according to a gradation conversion table as shown in FIG. 5A is carried out on an input signal Din to obtain an output signal Dout, for example. By inputting the output signal Dout to image display means having a gradation characteristic shown in FIG. 5B, a relationship (gradation characteristic) between the original input signal Din and output brightness N can become linear [FIG. 5C].

However, a display screen (a fluorescent screen of a CRT display, for example) of image display means or an electron gun thereof (backlight of a liquid crystal display device) for emission display degrades with time, and brightness of the screen changes in some cases.

In other words, since the gradation characteristic of the image display means initially shows brightness having a gradation in a high signal range [a curve (i) in FIG. 2A], the gradation characteristic of the input signal Din after the gradation correction shows linearity over an entire dynamic range (0~100%) of the input signal Din as shown by a curve (i) in FIG. 2B. However, if the brightness degradation sequentially progresses from a curve (ii) to (iii) or (iv) in FIG. 2A, the gradation becomes gradually flat from the high signal range and the gradation characteristic of the input signal Din after the gradation correction cannot display a gradation in the high signal range of the input signal Din, as shown by curves (ii), (iii), and (iv) in FIG. 2B.

For example, if the degradation is as shown in FIG. 2B(ii), a 90% value and a 100% value of the input signal Din show brightness N0, which means that gradation is not represented in this range. If the input signal Din is a signal of a medical radiation image (a negative image), a gradation in the high density range cannot be represented. Therefore, if an area of interest in the image exists in this high density range, observation and reading of the image is hindered and it becomes difficult to carry out a useful diagnosis.

There has been proposed a technique for preventing degradation of a final gradation characteristic regardless of brightness degradation (see Japanese Unexamined Patent Publication No. 9(1997)-212144), by correcting a gradation conversion table in accordance with brightness degradation of image display means (including a case of having gradation conversion tables corrected at a plurality of levels in advance).

According to this technique, as shown by curves (i), (ii), (iii), and (iv) in FIG. 3, gradation conversion tables for correcting degradation of gradation characteristics due to brightness degradation are used for each predetermined level of brightness degradation [(i), (ii), (iii), and (iv) in FIG. 2A]. By selecting and using one of the gradation conversion tables corresponding to detected brightness degradation, linearity of the gradation characteristic of the brightness N to the value of the input signal Din after the correction can be maintained over almost all the dynamic range of the input signal Din, as shown by curves (i), (ii), (iii), and (iv) in FIG. 4.

Brightness degradation is detected by using an image quality SMPTE pattern (a test pattern for image quality control recommended by the Society of Motion Picture and Television Engineers [in USA]; see FIG. 8). An observer views a contrast pattern P included in the SMPTE pattern and detects whether or not a gradation in a high signal range (a gradation between a brightness N0 corresponding to a maximum signal value (100%) and a brightness N1 corresponding to a signal value which is 95% of the maximum signal value) is represented. In this manner, the gradation detection is easily carried out.

In the contrast pattern P in the SMPTE pattern shown in FIG. 8, a small square is formed at the center of a large square and the brightness N1 corresponding to the signal value which is 95% of the maximum signal value (brightness after the gradation conversion using the gradation conversion table at the initial level shown in FIG. 3(i)) is displayed in the inner square while the brightness N0 corresponding to the maximum signal value (brightness after the gradation conversion using the gradation conversion table at the initial level) is displayed in an area of the outer square excluding the inner square. Before brightness degradation occurs, a brightness difference between the inner square and the outer area thereof can be recognized. However, after brightness degradation has occurred, no brightness difference is recognized between the inner square and the outer area thereof, since the gradation in the high signal range, that is, in a low brightness range has become flat. Therefore, gradation characteristic degradation can be detected by the change in the gradation recognition performance.

In the SMPTE pattern, a contrast pattern using brightness between 0% and 5% signal values is also available in a low signal range, that is, in a high brightness range. However, in the low signal range, the brightness degradation described above is not directly connected to the gradation degradation. Therefore, the gradation recognition performance does not change.

In the case where a contrast pattern shown in FIG. 9A (a contrast pattern using the brightness between 100% and 90% signal values) is used as the contrast pattern in the above-described high signal range where the gradation recognition performance changes, the brightness/input signal characteristic after gradation correction according to the original gradation conversion table [FIG. 3(i)] becomes the curve in FIG. 2B(ii) when the brightness of the image display means has degraded as shown in FIG. 2A(ii). In this case, the contrast pattern becomes as shown in FIG. 9B. As a result, the observer cannot recognize the gradation in the contrast pattern. Therefore, the gradation degradation is detected and the gradation conversion table is changed to a second gradation conversion table shown in FIG. 3(ii). The final brightness/input signal characteristic after the change becomes as shown in FIG. 4(ii), and the contrast pattern is changed to a gradation-recognizable pattern shown in FIG. 9C.

Gradation degradation gradually progresses from FIG. 2A(i) to (ii), then to (iii) and further to (iv). However, since the contrast pattern is not necessarily displayed each time an image is displayed on image display means, brightness degradation has progressed in some cases from the state (i) where no degradation is observed to (iii) or (iv) when it is realized. In this case, the gradation recognition performance of the contrast pattern is the same as the performance [shown by FIG. 9B] in the brightness degradation in the state shown in FIG. 2A(ii), even if the brightness degradation is actually in the state of (iii) or (iv). Therefore, the observer does not detect a degree of degradation by using the contrast pattern alone although the observer detects the degradation itself. As a result, the gradation conversion table enabling optimal gradation correction cannot be selected from the plurality of gradation conversion tables prepared in advance according to the brightness degradation. Therefore, it is necessary to find a gradation conversion table enabling the contrast pattern shown in FIG. 9B to have an adequate gradation characteristic shown in FIG. 9C by using each of the gradation conversion tables shown in FIG. 3(ii), (iii) and (iv) in trial and error, which imposes a troublesome operation on the observer.

The present invention has been conceived based on consideration of the above problems. An object of the present invention is therefore to provide an image display method and an image display apparatus for enabling easy selection of a gradation conversion table to be adopted in accordance with a degree of brightness degradation of image display means.

SUMMARY OF THE INVENTION

An image display method and an image display apparatus of the present invention have in advance a plurality of gradation conversion tables for correcting a gradation characteristic which degrades in accordance with brightness degradation of image display means, and displays contrast patterns at a plurality of levels changing gradation recognition performance in accordance with a level (degree) of the brightness degradation in order to detect the level of the brightness degradation at a glance.

In other words, the image display method of the present invention is a method of displaying on image display means a visible image represented by an image signal having been subjected to gradation conversion processing according to a predetermined gradation conversion table. The image display method comprises the steps of:

preparing a plurality of the gradation conversion tables according to a plurality of levels of brightness degradation of the image display means in order to correct a gradation characteristic degrading in accordance with the brightness degradation;

displaying contrast patterns at a plurality of levels having gradation recognition performance changing in accordance with the plurality of the levels of the brightness degradation of the image display means;

selecting one of the gradation conversion tables adequate for correcting the gradation characteristic in accordance with a change of the gradation recognition performance of the contrast patterns at the plurality of the levels; and carrying out the gradation conversion processing according to the gradation conversion table having been selected.

The number of gradation conversion tables prepared according to the levels of the brightness degradation is a number corresponding to the levels of brightness degradation to be corrected. Therefore, if the levels of brightness degradation to be corrected are 2, 2 gradation conversion tables are sufficient. Since it is preferable for the levels of brightness degradation to be 3 or more, the number of the gradation conversion tables is preferably 3 or more.

The number of contrast patterns having changing gradation recognition performance is preferably a number corresponding to the levels of brightness degradation to be corrected, as in the case of the gradation conversion tables. However, displaying the contrast patterns at more levels, that is, displaying more contrast patterns than the number of levels of the brightness degradation to be corrected, is permissible.

"Preparing a plurality of the gradation conversion tables according to a plurality of levels of brightness degradation" refers to preparing a plurality of gradation conversion tables having different conversion characteristics. Alternatively, by preparing only one gradation conversion table but having correction tables for correcting output of the gradation conversion table to combine the only gradation conversion table and the correction tables, a plurality of gradation conversion tables may be used in practice.

The image display means includes emission display means such as a CRT display and a liquid crystal display device.

An image display apparatus of the present invention is an apparatus for realizing the above image display method. The image display apparatus displays on image display means a visible image represented by an image signal having been subjected to gradation conversion processing by a gradation correction unit thereof for carrying out the gradation conversion processing on the image signal according to a predetermined gradation conversion table. The image display apparatus comprises:

a plurality of gradation conversion tables for a plurality of levels of brightness degradation of the image display means in order to correct a characteristic of a gradation degrading with the brightness degradation;

a contrast pattern storing unit for storing contrast patterns at a plurality of levels having gradation recognition performance changing in accordance with the levels of brightness degradation of the image display means, and gradation conversion table selection means for selecting one of the gradation conversion tables adequate for correcting the gradation in accordance with a change in the gradation recognition performance of the contrast patterns at the plurality of the levels, and the gradation correction unit carries out the gradation conversion processing on the image signal according to the gradation conversion table having been selected.

According to the image display method and apparatus of the present invention, by simultaneously displaying on the image display means the contrast patterns at the plurality of levels having the gradation recognition performance changing in accordance with the brightness degradation level of the image display means such as a CRT display or a liquid crystal display, the level (degree) of the brightness degradation can be detected at a glance and the gradation conversion table adequately correcting the gradation at the detected degradation level can be selected easily from the plurality of gradation conversion tables prepared to correct the gradation characteristic degrading in accordance with the brightness degradation of the image display means.

DESCRIPTION OF THE PREFERRED EMBODIMENT

Hereinafter, an embodiment of an image display apparatus for realizing an image display method of the present invention will be explained with reference to the accompanying drawings.

Figure 1:
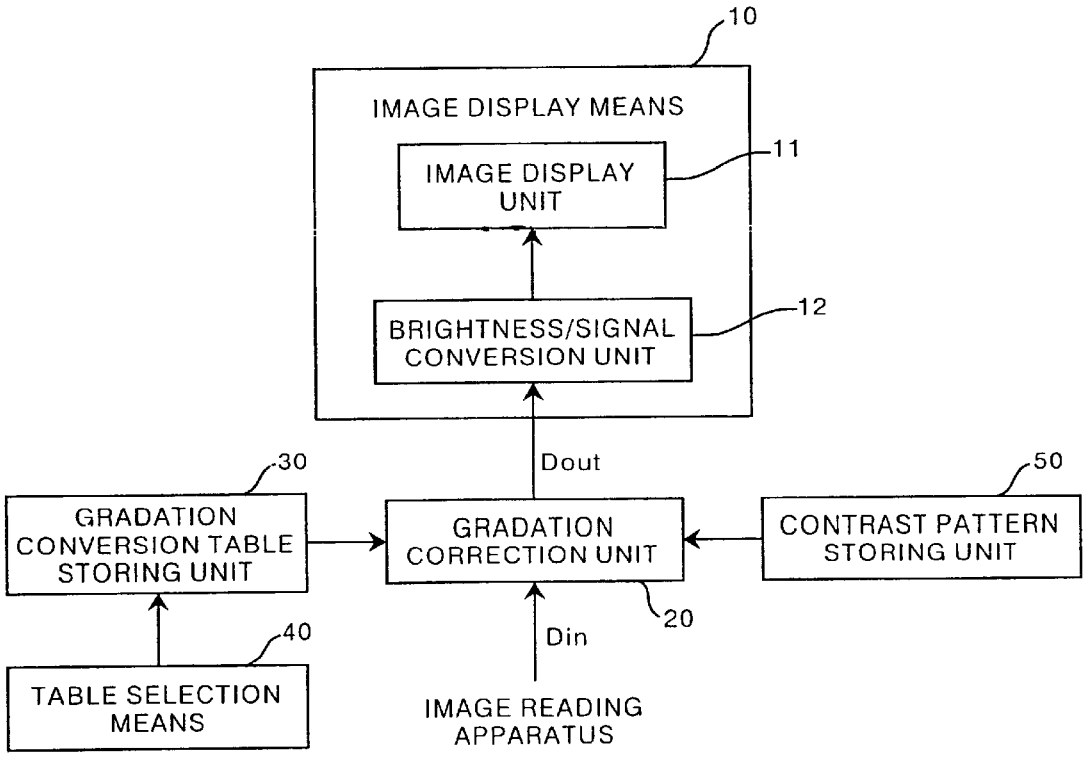
FIG. 1 is a block diagram showing an embodiment of an image display apparatus of the present invention.

FIG. 1 is a block diagram showing an embodiment of the image display apparatus of the present invention. The image display apparatus shown in FIG. 1 is a display apparatus for displaying medical images. The image display apparatus comprises a gradation conversion table storing unit 30 for storing a plurality of gradation conversion tables (look-up tables; LUT) each having different input/output characteristics, table selection means 40 for selecting one of the gradation conversion tables stored in the gradation conversion table storing unit 30, a gradation correction unit 20 for carrying out gradation conversion processing according to the gradation conversion table selected by the table selection means 40 on an image signal Din obtained by an image reading apparatus or the like, image display means 10 for displaying a visible image represented by an image signal Dout after the gradation conversion processing by the gradation correction unit 20, and a contrast pattern storing unit 50 for storing contrast patterns to be displayed on the image display means 10 at a plurality of levels having different gradation recognition performance according to a plurality of levels of brightness degradation of the image display means 10.

Figure 2A:
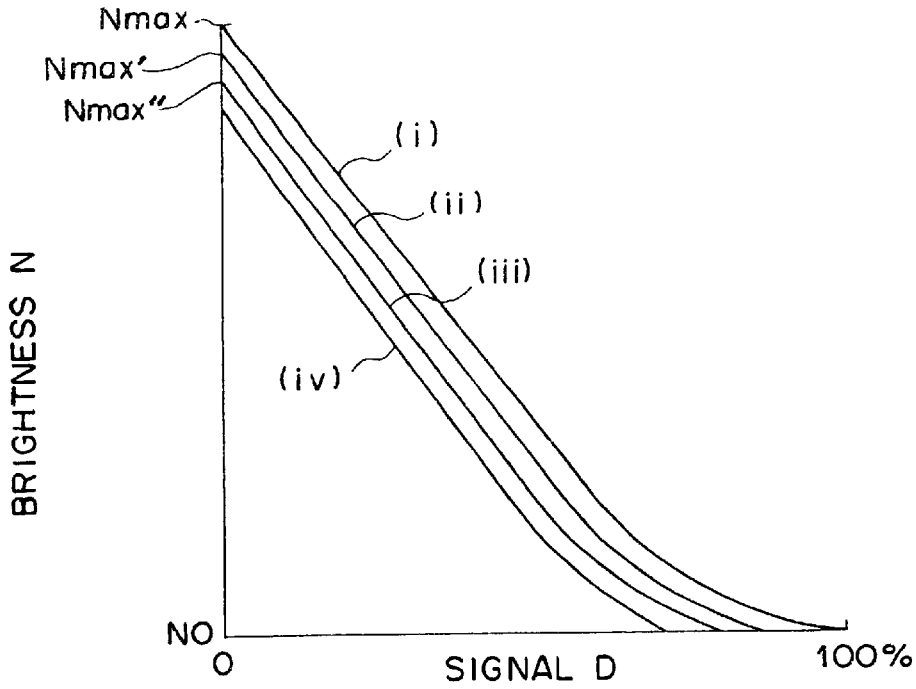
FIGS. 2A and 2B are graphs showing conversion characteristics (gradation characteristics) of image display means (a brightness/signal conversion unit)

The image display means 10 comprises a brightness/signal conversion unit 12 for converting an image signal D representing an input image into brightness according to a predetermined characteristic and for outputting the brightness, and an image display unit 11 for displaying a visible image having a brightness distribution obtained by the conversion by the brightness/signal conversion unit 12. A characteristic of conversion (a gradation characteristic) from the image signal D into brightness N by the brightness/signal conversion unit 12 is as shown in FIG. 2A, for example. In other words, according to this characteristic, when the input signal D is a minimum (=0), maximum brightness Nmax is output and when the input signal D is a maximum (=100%), minimum brightness N0 is output. The gradation conversion characteristic of the brightness/signal conversion unit 12 is shown by the curve (i) in FIG. 2A at an initial state having no brightness degradation, and sequentially degrades from the curve (i) to the curve (ii) and then to (iii) and to (iv) with time. This brightness degradation is not a step-like change from (i) to (ii) to (iii) then to (iv) but a gradual change. Therefore, the degradation in the explanation above refers to a change from the curve (i) to (ii) after a certain time interval.

The image display unit 11 may be a CRT display or a liquid crystal display.

Figure 3:
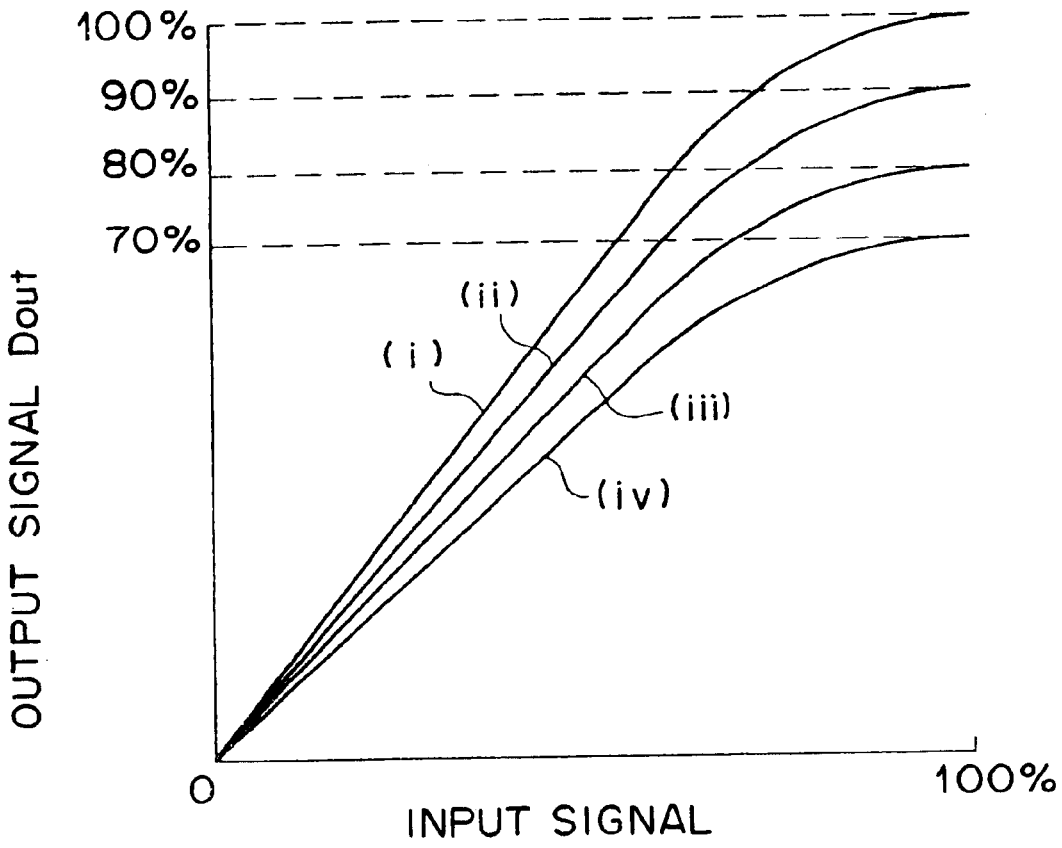
FIG. 3 is a graph showing input/output conversion characteristics of gradation conversion tables.

The gradation conversion tables stored in the gradation conversion table storing unit 30 have conversion characteristics shown by the curves (i), (ii), (iii), and (iv) in FIG. 3, for example. The curve (i) is a default gradation conversion table and the image signal Din input to this gradation conversion table (i) is converted into the image signal Dout according to the gradation conversion table (i). When the converted image signal Dout is input to the gradation characteristic (i) in the brightness/signal conversion unit 12 [FIG. 2A], the gradation characteristic between the original input signal Din and the output brightness N becomes a linear characteristic of the brightness/signal conversion unit 12 shown by the curve (i) in FIG. 4. This operation is expressed schematically as an operation causing the gradation characteristic between the input signal Din and the brightness N to become linear as shown in FIG. 5C by carrying out input/output conversion according to the gradation conversion table having the characteristic shown by FIG. 5A on the signal D input to the brightness/signal conversion unit 12 having the characteristic shown by FIG. 5B.

Figure 2B:
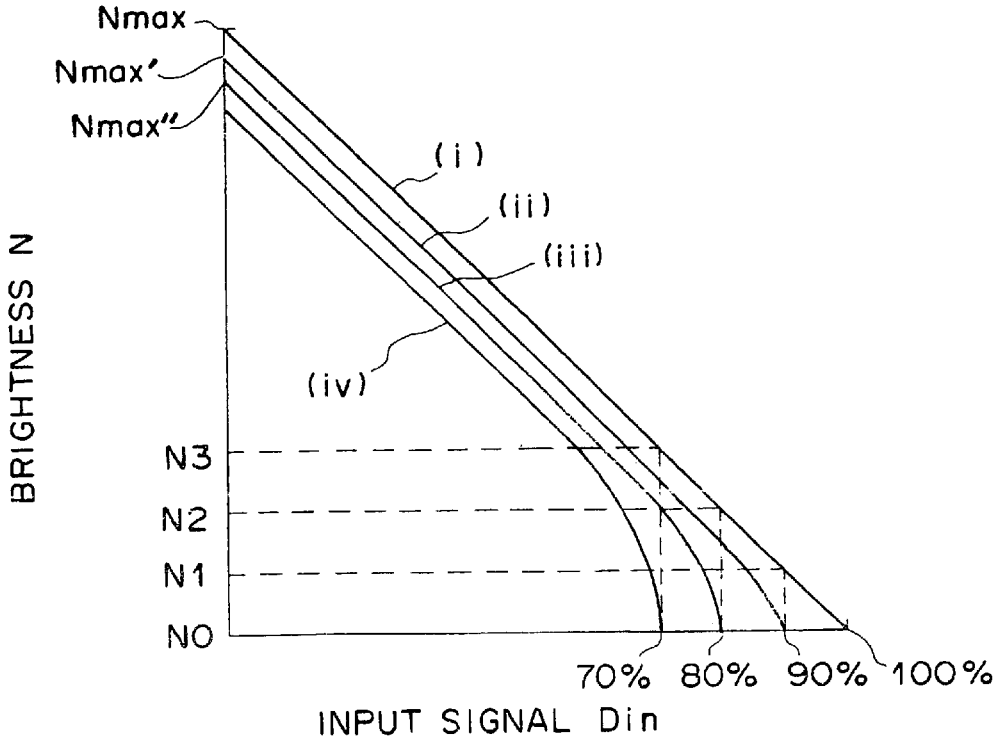

When the characteristic of the brightness/signal conversion unit 12 shown by FIG. 2A degrades to the curves (ii) to (iii) to (iv), the final gradation characteristic between the input image signal Din and the output brightness N is as shown by the curves (ii), (iii), and (iv) in FIG. 2B. In other words, in the characteristic shown by the curve (ii), the maximum brightness decreases to Nmax' (<Nmax), and the gradation recognition performance degrades since the output brightness N changes to the minimum brightness N0 in a range larger than 90% of the input signal Din. The maximum brightness of the characteristic shown by the curve (iii) decreases to Nmax" (<Nmax), and the gradation recognition performance also degrades since the output brightness N changes to the minimum brightness N0 in a range larger than 80% of the input signal Din. The maximum brightness of the characteristic shown by the curve (iv) decreases and the gradation recognition performance also degrades since the output brightness N changes to the minimum brightness N0 in a range larger than 70% of the input signal Din.

Meanwhile, the gradation conversion table (ii) stored in the gradation conversion table storing unit 30 is a gradation conversion table adequate for the characteristic of the brightness/signal conversion unit 12 degraded as shown by the curve (ii) in FIG. 2A. The image signal Din input to the gradation conversion table (ii) is converted into the image signal Dout according to the gradation conversion table (ii). When the image signal Dout obtained by the conversion is input to the gradation characteristic (ii) [shown in FIG. 2A] of the brightness/signal conversion unit 12, the gradation characteristic between the original image signal Din and the brightness N shows linearity of the brightness/signal conversion unit 12 shown by FIG. 4(ii). In other words, the gradation conversion table (ii) carries out nonlinear conversion of the input image signal Din into the signal Dout having a dynamic range which is 90% of the dynamic range of the original image signal Din (0~100%). Therefore, if the signal Dout is input to the gradation characteristic (ii) of the brightness/signal conversion unit 12 which can represent the gradation only in a range between 0% and 90% of the signal D, gradation representation becomes possible over the entire dynamic range (0~100%) of the original image signal Din.

Likewise, the gradation conversion table (iii) stored in the gradation conversion table storing unit 30 is a gradation conversion table adequate for the characteristic of the brightness/signal conversion unit 12 degraded as shown by FIG. 2A(iii). The gradation conversion table (iv) is a gradation conversion table adequate for the characteristic of the brightness/signal conversion unit 12 degraded as shown in FIG. 2A(iv). In other words, the image signal Din input to the gradation conversion table (iii) is converted into the image signal Dout according to the gradation conversion table (iii). When the image signal Dout having been obtained in the above manner is input to the gradation characteristic (iii) of the brightness/signal conversion unit 12 [FIG. 2A], the gradation characteristic between the original image signal Din and the brightness N to be output becomes a linear characteristic of the brightness/signal conversion unit 12 shown in FIG. 4(iii). The image signal Din input to the gradation conversion table (iv) is converted into the image signal Dout according to the gradation conversion table (iv), and when the image signal Dout obtained by the conversion is input to the gradation characteristic (iv) [FIG. 2A] of the brightness/signal conversion unit 12, the gradation characteristic between the original image signal Din and the brightness N to be output becomes a linear characteristic of the brightness/signal conversion unit 12 shown in FIG. 4(iv).

Figure 6A:
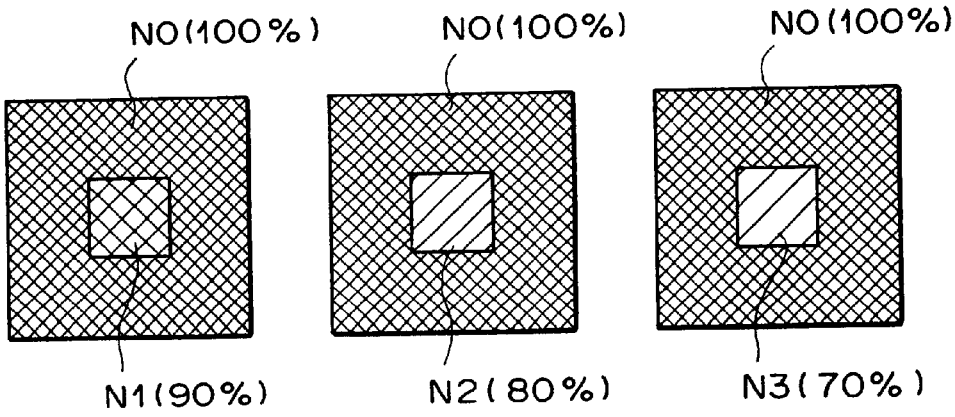
FIGS. 6A and 6B are diagrams showing examples of contrast patterns to be displayed.

The contrast patterns stored in the contrast pattern storing unit 50 are 3 contrast patterns shown in FIG. 6A, for example. These contrast patterns are test patterns displayed at the same time on the image display means 10 by adopting the default gradation conversion table [FIG. 3(i)]. The leftmost pattern in FIG. 6A is a contrast pattern of brightness corresponding to a maximum value (100%) of the input signal Din and 90% thereof (corresponding to the brightness N0 and N1 before brightness degradation), respectively. The contrast pattern in the middle is a contrast pattern of brightness corresponding to the maximum value (100%) of the input signal Din and 80% thereof (corresponding to brightness N0 and N2 before brightness degradation), respectively. The contrast pattern on the right is a contrast pattern of brightness corresponding to the maximum value (100%) of the input signal Din and 70% thereof (corresponding to brightness N0 and N3 before brightness degradation), respectively.

An operation of the image display apparatus in this embodiment will be explained next.

Initially, the gradation characteristic of the brightness/signal conversion unit 12 does not show brightness degradation, as shown in FIG. 2A(i).

The image signal Din representing a radiation image of a predetermined patient is input from an image reading apparatus or the like to the gradation correction unit 20 of the image display apparatus in this embodiment. At this time, the default table [FIG. 3(i)] out of the 4 gradation conversion tables stored in the gradation conversion table storing unit 30 is input to the gradation correction unit 20. Meanwhile, signals representing the contrast patterns [FIG. 6A] stored in the contrast pattern storing unit 50 are also input to the gradation correction unit 20.

The gradation correction unit 20 carries out input/output conversion (pre-correction of gradation) according to the default gradation conversion table on the image signal Din and the signals representing the contrast patterns input thereto, and outputs the image signal Dout after the pre-conversion and the signals representing the contrast patterns after the pre-conversion. The image signal Dout and the contrast pattern signals are input to the brightness/signal conversion unit 12 of the image display means 10.

The brightness/signal conversion unit 12 outputs to the image display unit 11 distributions of the brightness N corresponding to the image signal Dout and the contrast patterns according to the gradation characteristic thereof [FIG. 2A(i)], and the image display unit 11 displays the visible image and the contrast patterns having the distributions of the brightness N input thereto.

The gradation characteristic which is a relationship between the original input image signal Din as well as the signal values representing the contrast patterns and the brightness N displayed finally is as shown in FIG. 4(i) [the same as FIG. 2B(i)]. Therefore, the 3 contrast patterns displayed have the respective brightness N1, N2 or N3 at the center thereof and N0 at the periphery thereof, meaning representation of preferable gradations for all the contrast patterns.

An observer such as a doctor recognizing the gradations of the 3 contrast patterns displayed on the image display unit 11 can easily judge that the preferable gradations are maintained.

The case where the gradation characteristic of the brightness/signal conversion unit 12 has degraded to the characteristic shown by FIG. 2A(iii) will be explained next.

The image signal Din representing the radiation image of the predetermined patient is input from the image reading apparatus or the like to the gradation correction unit 20, as has been described above. At this time, the default table [FIG. 3(i)] out of the 4 gradation conversion tables stored in the gradation conversion table storing unit 30 is input to the gradation correction unit 20. Meanwhile, the signals representing the contrast patterns [FIG. 6A] stored in the contrast pattern storing unit 50 are also input to the gradation correction unit 20.

The gradation conversion unit 20 carries out the input/output conversion (the pre-conversion of gradation) according to the default conversion table on the image signal Din and the signals representing the contrast patterns input thereto, and outputs the image signal Dout and the signals representing the contrast patterns after the conversion. The image signal Dout and the signals representing the contrast patterns are input to the brightness/signal conversion unit 12 of the image display means 10.

The brightness/signal conversion unit 12 outputs to the image display unit 11 the distributions of the brightness N corresponding to the image signal Dout and the contrast patterns according to the degraded gradation characteristic [FIG. 2A(iii)]. The image display unit 11 displays the visible image and the contrast patterns having the distributions of the brightness N input thereto.

The gradation characteristic which is the relationship between the original input image signal Din as well as the signals representing the contrast patterns and the brightness N displayed finally is as shown in FIG. 2A(iii). In other words, the relationship between the input signal Din and the output brightness N obtained by a combination of the degraded characteristic of the brightness/signal conversion unit 12 and the default gradation conversion table shows the brightness N0 in a range over 80% of the maximum (100%) of the input signal Din, which means a flat gradation. Therefore, 2 contrast patterns from the left displayed on the image display unit 11 out of the 3 contrast patterns [FIG. 6A] have brightness N0 both at the center and periphery thereof, meaning a flat gradation.

As has been described above, since the gradation cannot be recognized for the 2 contrast patterns out of the 3 contrast patterns displayed, the observer can detect necessity of 2-stage gradation correction at a glance. Therefore, the observer inputs an instruction to the table selection means 40 in order to select the gradation conversion table [FIG. 3(iii)] corresponding to the 2-stage gradation correction.

The table selection means 40 selects the gradation conversion table [FIG. 3(iii)] corresponding to the 2-stage gradation correction from the 4 gradation conversion tables stored in the gradation conversion table storing means 30, according to the instruction input thereto. The selected table (iii) is then input to the gradation correction unit 20.

The gradation correction unit 20 carries out the input/output conversion (the pre-correction of gradation) according to the selected table (iii) on the image signal Din and the signals representing the contrast patterns, and outputs the image signals Dout and the signals representing the contrast patterns after the conversion. The signal Dout and the signals representing the contrast patterns after the conversion are input to the brightness/signal conversion unit 12 of the image display means 10.

The brightness/signal conversion unit 12 outputs to the image display unit 11 the distributions of the brightness N corresponding to the image signal Dout and the contrast patterns according to the gradation characteristic thereof [FIG. 2A(iii)], and the image display unit 11 displays the visible image and the contrast patterns having the distributions of brightness N input thereto.

Figure 4:
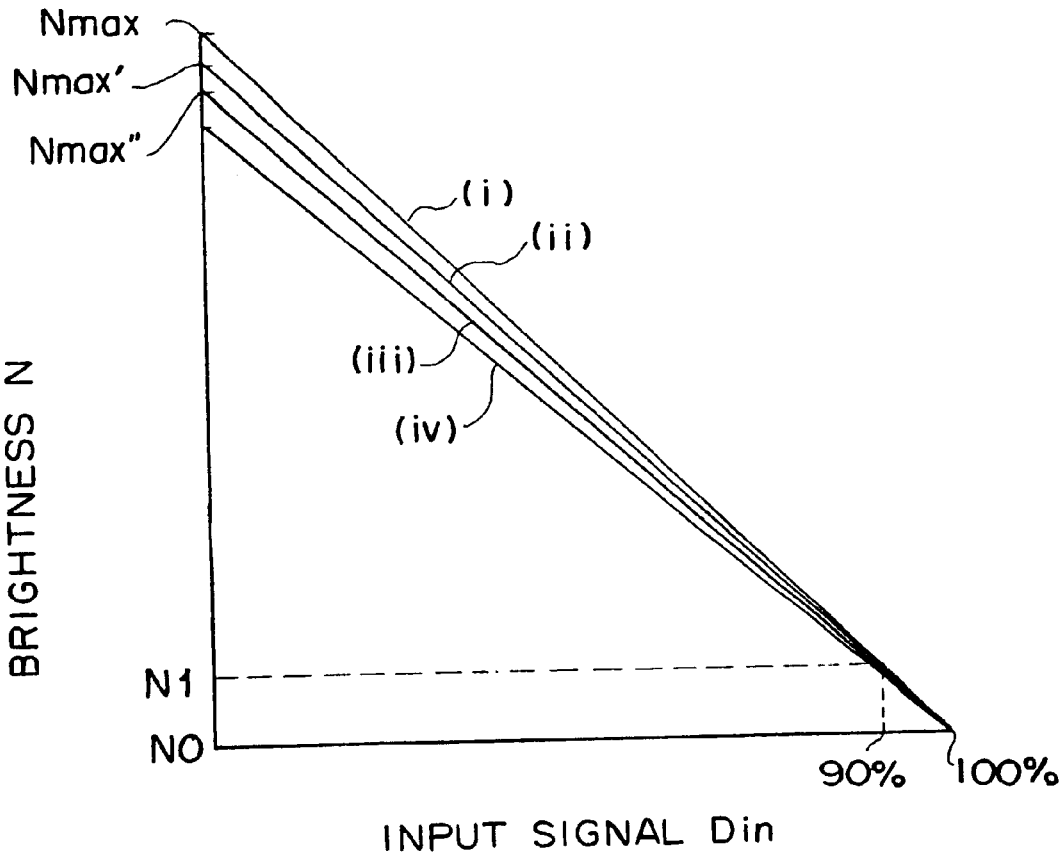
FIG. 4 is a graph showing gradation characteristics after correction.
Figure 5C:
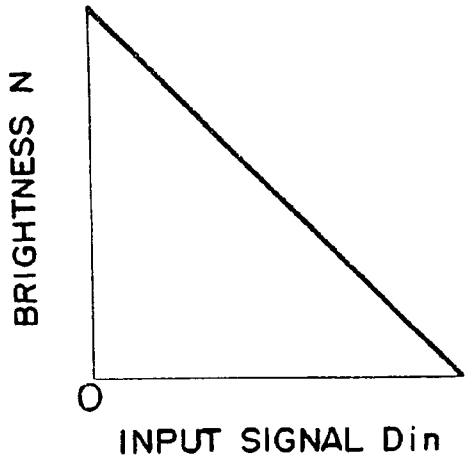
FIGS. 5A through 5C are graphs explaining an operation of gradation correction by a gradation correction unit.
Figure 5B:
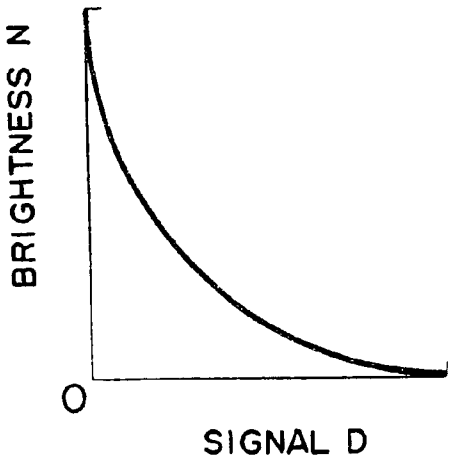
Figure 5A:
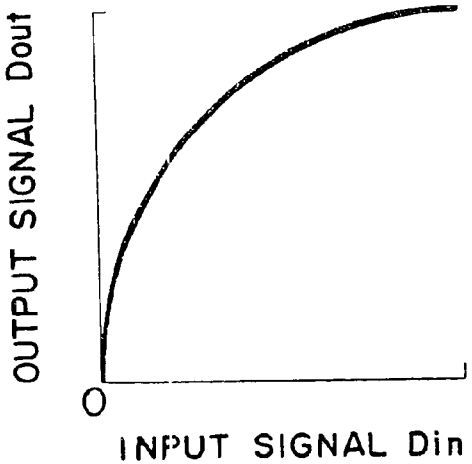

The gradation characteristic which is the relationship between the original input image signal Din as well as the signal values representing the contrast patterns and the brightness N finally displayed is as shown in FIG. 4(iii). Therefore, all of the 3 contrast patterns displayed on the image display unit 11 have predetermined differences between the brightness at the center and periphery thereof, and preferable gradations are represented for all the contrast patterns.

Therefore, the observer recognizing the gradations of the 3 contrast patterns displayed on the image display unit 11 can easily judge that the preferable gradations are maintained.

In the case where the gradation characteristic of the brightness/signal conversion unit 12 has degraded to the characteristic shown by FIG. 2A(ii), one of the 3 contrast patterns displayed on the image display unit 11 has a flat gradation by combination with the default gradation conversion table [FIG. 3(i)]. Therefore, the observer can easily detect the necessity of 1-stage gradation correction, and inputs an instruction to the table selection means 40 in order to select the gradation conversion table [FIG. 3 (ii)] corresponding to the 1-stage gradation correction.

As has been described above, according to the image display apparatus in this embodiment, the level of the brightness degradation of the brightness/signal conversion unit 12 can be detected easily by displaying at the same time the 3 contrast patterns having the changing gradation recognition performance according to the 3 levels of the brightness degradation of the brightness/signal conversion unit 12. By easily and at once selecting the gradation conversion table enabling adequate correction of the gradation characteristic degradation due to the brightness degradation of the brightness/signal conversion unit 12 according to the gradation recognition performance of the 3 contrast patterns, gradation degradation can be corrected.

Figure 6B:
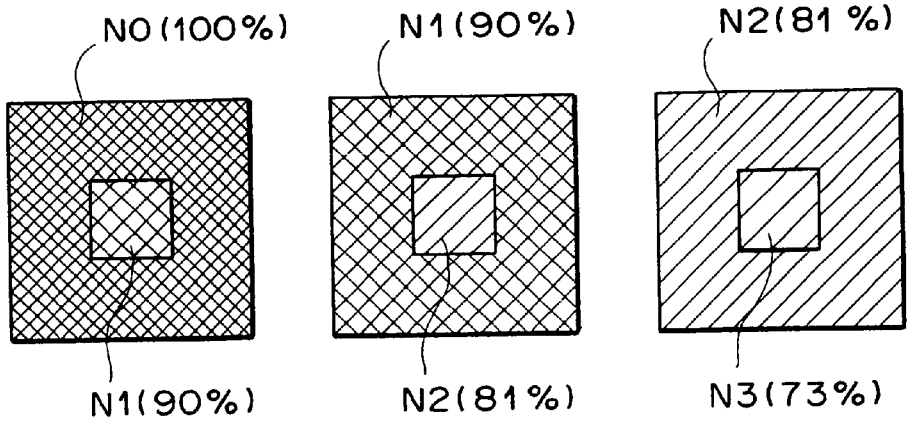

In the image display apparatus in this embodiment, input signal ratios of the 3 contrast patterns to be displayed are set to 100%/90%, 100%/80%, and 100%/70%. However, the image display method and apparatus of the present invention does not limit the ratios to those described above, and 3 contrast patterns having the input signal ratios 100%/95%, 100%/90%, and 100%/85% may be used to detect the brightness degradation of the brightness/signal conversion unit 12 at a high resolution. Furthermore, the input signal of the periphery area of each of the contrast patterns is not necessarily set to 100%, and 3 contrast patterns having the same input signal ratios such as 100%/90%, 90%/81%, and 81%/73% may be used, as shown in FIG. 6B.

Moreover, the contrast patterns to be displayed are not limited to 3, and 4 contrast patterns comprising a combination such as 100%/90%, 100%/80%, 100%/70% and 100%/60% or 100%/90%, 90%/81%, 80%/72%, 70%/63% may also be used. Alternatively, 5 or more contrast patterns may also be used.

Figure 7:
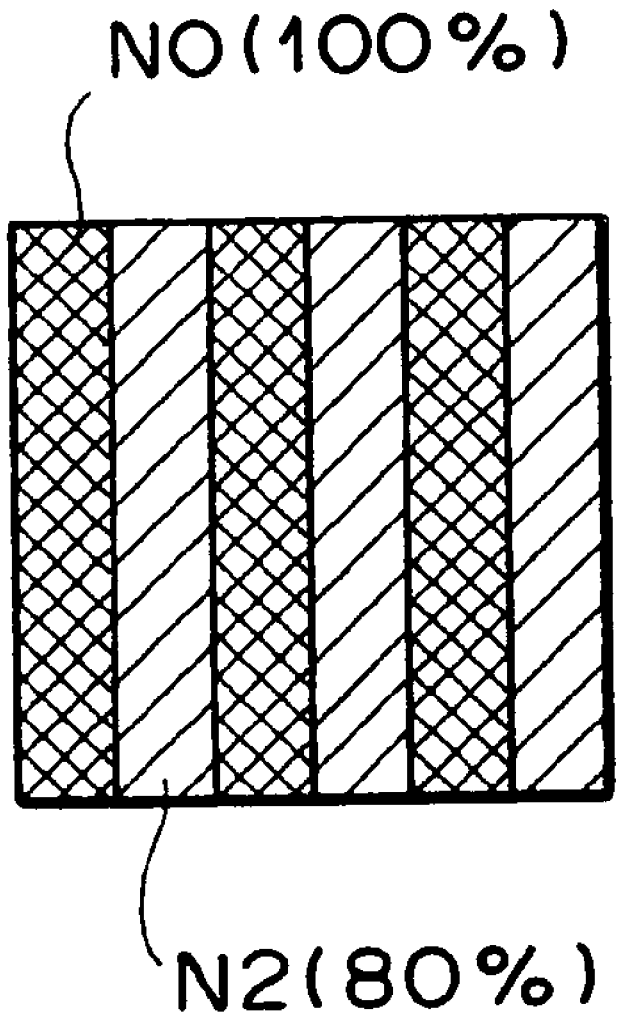
FIG. 7 is a diagram showing another example of the contrast pattern.
Figure 8:
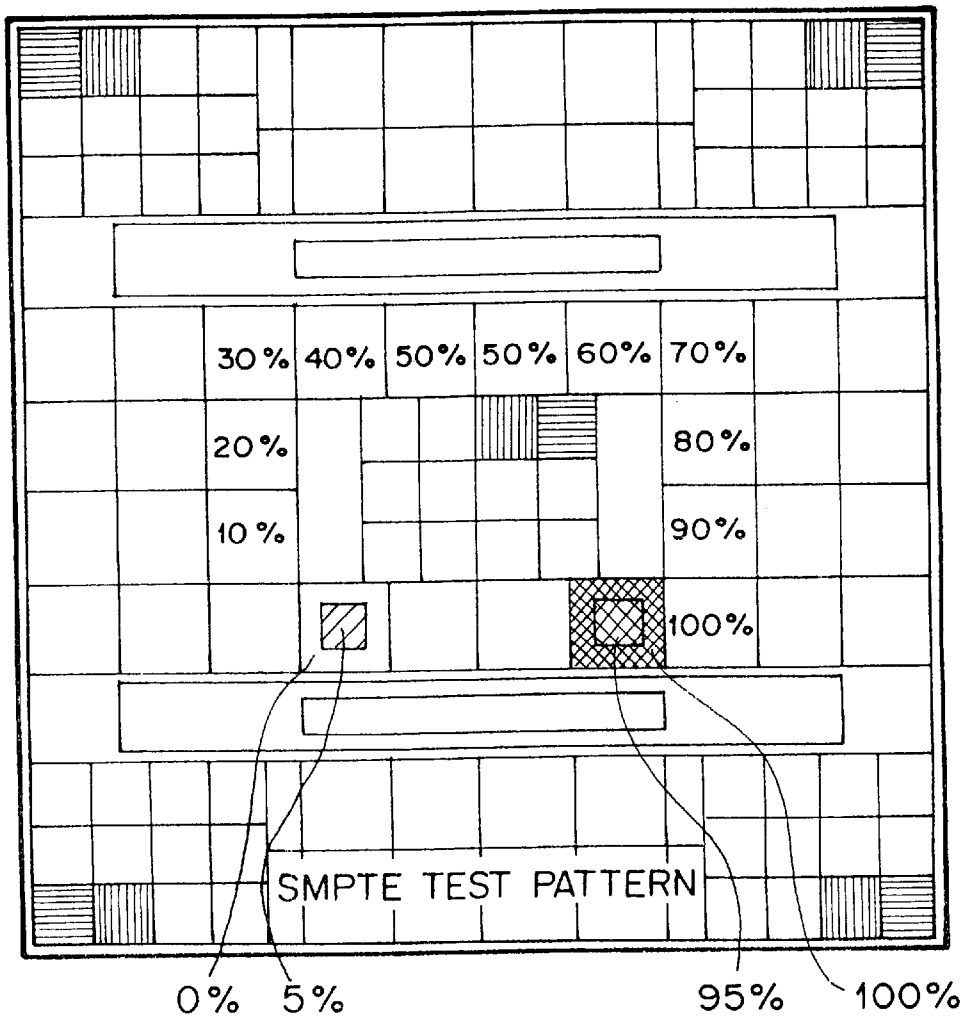
FIG. 8 is a diagram showing an SMPTE pattern.
Figure 9A:
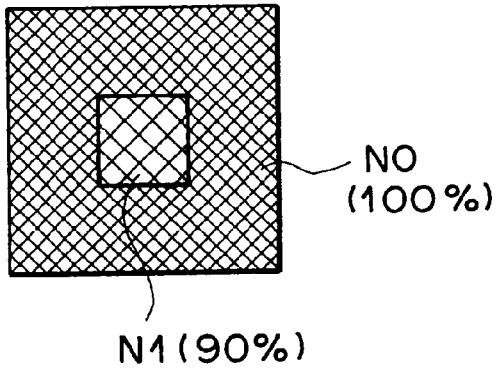
FIGS. 9A through 9C are diagrams explaining an operation in which recognition performance of the contrast pattern changes in accordance with brightness degradation.
Figure 9B:
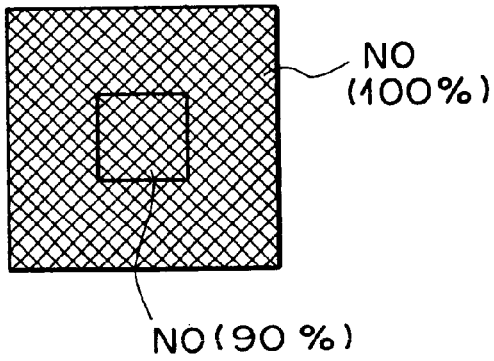
Figure 9C:
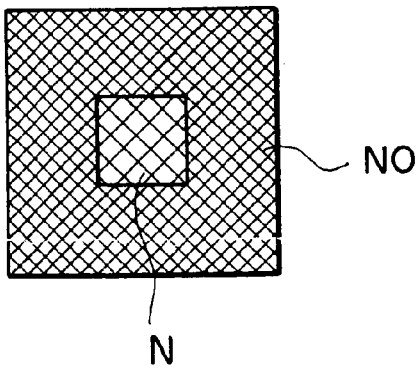

As a shape of the contrast patterns, not only the shape combining the rectangles as shown by FIG. 6 but also a pattern having rectangular stripes as shown by FIG. 7 or a shape comprising circles may be used. In other words, patterns of any shape enabling easy visualization of the contrast and enabling brightness distributions output for different signal values to be displayed adjacent to each other may be used.

In the image display apparatus in this embodiment, the image signal Din input from the image reading apparatus or the like and the contrast patterns are displayed at the same time on the image display unit 11. However, the contrast patterns may be displayed only at the time of checking the degree of the brightness degradation of the brightness/signal conversion unit 12.

The gradation conversion table selected by the table selection means 40 may also be input as a default table in the gradation correction unit 20.

In addition, all of the contents of Japanese Patent Application No. 11(1999)-209573 are incorporated into this specification by reference.

What is claimed is:

1. A method of displaying on image display means a visible image represented by an image signal having been subjected to gradation conversion processing according to a predetermined gradation conversion table, the image display method comprising:

preparing a plurality of the gradation conversion tables according to a plurality of levels of brightness degradation of the image display means in order to correct a gradation characteristic degrading in accordance with the brightness degradation;

displaying contrast patterns at a plurality of levels having gradation recognition performance changing in accordance with the plurality of levels of brightness degradation of the image display means;

selecting one of the gradation conversion tables adequate for correcting the gradation characteristic in accordance with a change of the gradation recognition performance of the contrast patterns at the plurality of the levels; and carrying out the gradation conversion processing according to the gradation conversion table having been selected.

2. An apparatus for displaying on image display means a visible image represented by an image signal having been subjected to gradation conversion processing by a gradation correction unit thereof for carrying out the gradation conversion processing on the image signal according to a predetermined gradation conversion table, the image display apparatus comprising:

a plurality of gradation conversion tables for a plurality of levels of brightness degradation of the image display means prepared for correcting a characteristic of a gradation degrading with the brightness degradation;

a contrast pattern storing unit for storing contrast patterns at a plurality of levels having gradation recognition performance changing in accordance with the levels of the brightness degradation of the image display means; and gradation conversion table selection means for selecting one of the gradation conversion tables adequate for correcting the gradation in accordance with a change in the gradation recognition performance of the contrast patterns at the plurality of levels;

said gradation correction unit carrying out the gradation conversion processing on the image signal according to the gradation conversion table having been selected.

3. The method of displaying a visible image on an image display means of claim 1, wherein the number of gradation conversion tables prepared according to the levels of the brightness degradation corresponds to the number of levels of brightness degradation.

4. The method of displaying a visible image on an image display means of claim 3, wherein the number of gradation conversion tables is at least 3.

5. The method of displaying a visible image on an image display means of claim 1, wherein the number of contrast patterns having changing gradation recognition performance is equal to or greater than the number of levels of the brightness degradation to be corrected.

6. The method of displaying a visible image on an image display means of claim 1, wherein the plurality of gradation conversion tables is obtained by combining a single gradation conversion table with each of a plurality of correction tables that correct the output of the single gradation conversion table.

7. The method of claim 1, wherein each of the plurality of gradation conversion tables corrects an input signal to have a corresponding brightness level for display on the image display means.

8. The method of claim 7, wherein the image signal comprises a medical image signal.

9. The method of claim 2, wherein each of the plurality of gradation conversion tables corrects an input signal to have a corresponding brightness level for display on the image display means.

* * * * *